US011327414B2

(12) United States Patent
Hatano

(10) Patent No.: US 11,327,414 B2
(45) Date of Patent: May 10, 2022

(54) TONER, TONER CARTRIDGE, AND IMAGE FORMING APPARATUS

(71) Applicant: TOSHIBA TEC KABUSHIKI KAISHA, Tokyo (JP)

(72) Inventor: Takumi Hatano, Yokohama Kanagawa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 157 days.

(21) Appl. No.: 16/786,344

(22) Filed: Feb. 10, 2020

(65) Prior Publication Data

US 2021/0247703 A1 Aug. 12, 2021

(51) Int. Cl.

| | |
|---|---|
| ***G03G 9/087*** | (2006.01) |
| ***G03G 15/20*** | (2006.01) |
| ***G03G 15/08*** | (2006.01) |

(52) U.S. Cl.

CPC ..... *G03G 9/08755* (2013.01); *G03G 15/0865* (2013.01); *G03G 15/2039* (2013.01)

(58) Field of Classification Search

CPC ..... G03G 9/08755; G03G 15/0865; G03G 15/2039

See application file for complete search history.

(56) References Cited

U.S. PATENT DOCUMENTS

2013/0171555 A1 7/2013 Kubo et al.

FOREIGN PATENT DOCUMENTS

| | | | | |
|---|---|---|---|---|
| JP | H03200184 A | | 9/1991 | |
| JP | 2004163846 A | | 6/2004 | |
| JP | 2005148755 A | * | 6/2005 | ..... H05B 1/023 |
| JP | 2012220569 A | * | 11/2012 | |
| JP | 2013024985 A | | 2/2013 | |

* cited by examiner

*Primary Examiner* — Ryan D Walsh
(74) *Attorney, Agent, or Firm* — Kim & Stewart LLP

(57) ABSTRACT

A toner comprises toner particles containing a colorant, non-crystalline polyester, and crystalline polyester. The crystalline polyester does not contain an esterification catalyst and has a melting point in a range of 80 to 110° C. A gel content of the toner particles is in the range of 4 to 11% by mass.

20 Claims, 4 Drawing Sheets

TONER, TONER CARTRIDGE, AND IMAGE FORMING APPARATUS

FIELD

Embodiments described herein relate generally to a toner.

BACKGROUND

A melting point of toner containing non-crystalline polyester decreases when a portion of the non-crystalline polyester is replaced with crystalline polyester. Accordingly, when such toner is used in electrophotographic printing, the toner image can be fixed on a recording medium at a relatively low temperature.

However, toner containing crystalline polyester generally is more difficult to store stably, i.e., without degradation of the toner's characteristics (hereinafter this may be referred to as "storage stability"). A toner having a low melting point also tends to have a low viscosity upon melting. For that reason, when such toner is used in printing, high temperature offset is likely to occur.

DETAILED DESCRIPTION

In general, a toner according to an embodiment comprises toner particles containing a colorant, non-crystalline polyester, and crystalline polyester. The crystalline polyester does not contain an esterification catalyst and has a melting point in a range of 80 to 110° C. A gel content of the toner particles is in the range of 4 to 11% by mass.

According to another embodiment, an image forming apparatus includes a photoreceptor, an optical unit that irradiates the photoreceptor with light and forms an electrostatic latent image thereon, a developing unit that supplies a developer containing a toner to the photoreceptor on which the electrostatic latent image is formed and forms a toner image corresponding to the electrostatic latent image, and a transfer device that transfers the toner image directly or indirectly from the photoreceptor onto a recording medium. The toner contains a colorant, non-crystalline polyester, and crystalline polyester. The crystalline polyester does not contain an esterification catalyst and has a melting point in a range of 80 to 110° C. The toner particles have a gel content which is in the range of 4 to 11% by mass.

Hereinafter, example embodiments will be described with reference to the drawings.

1. IMAGE FORMING APPARATUS

Figure 1:
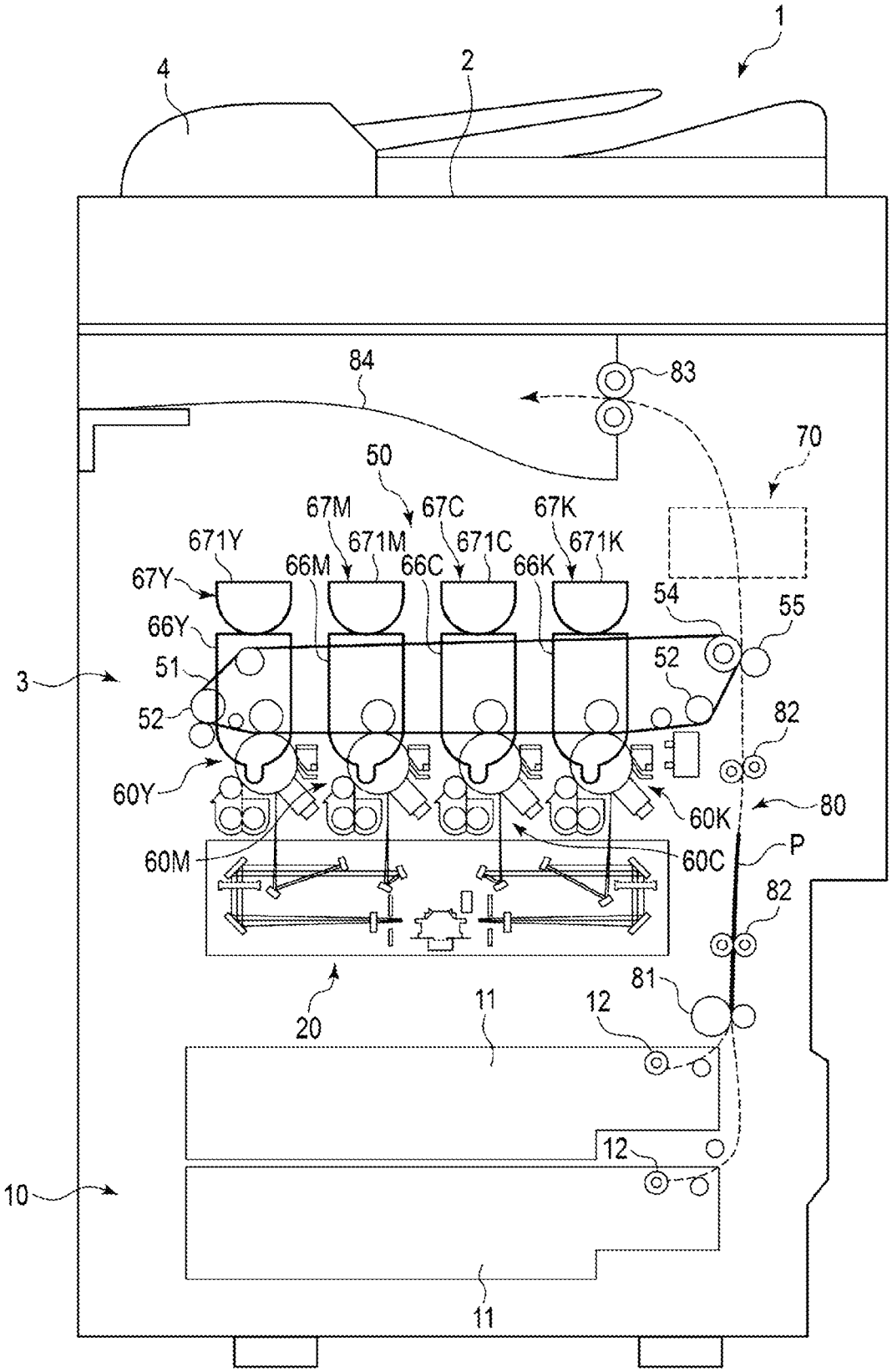
FIG. 1 schematically illustrates a cross-sectional view of an image forming apparatus according to an embodiment.
Figure 2:
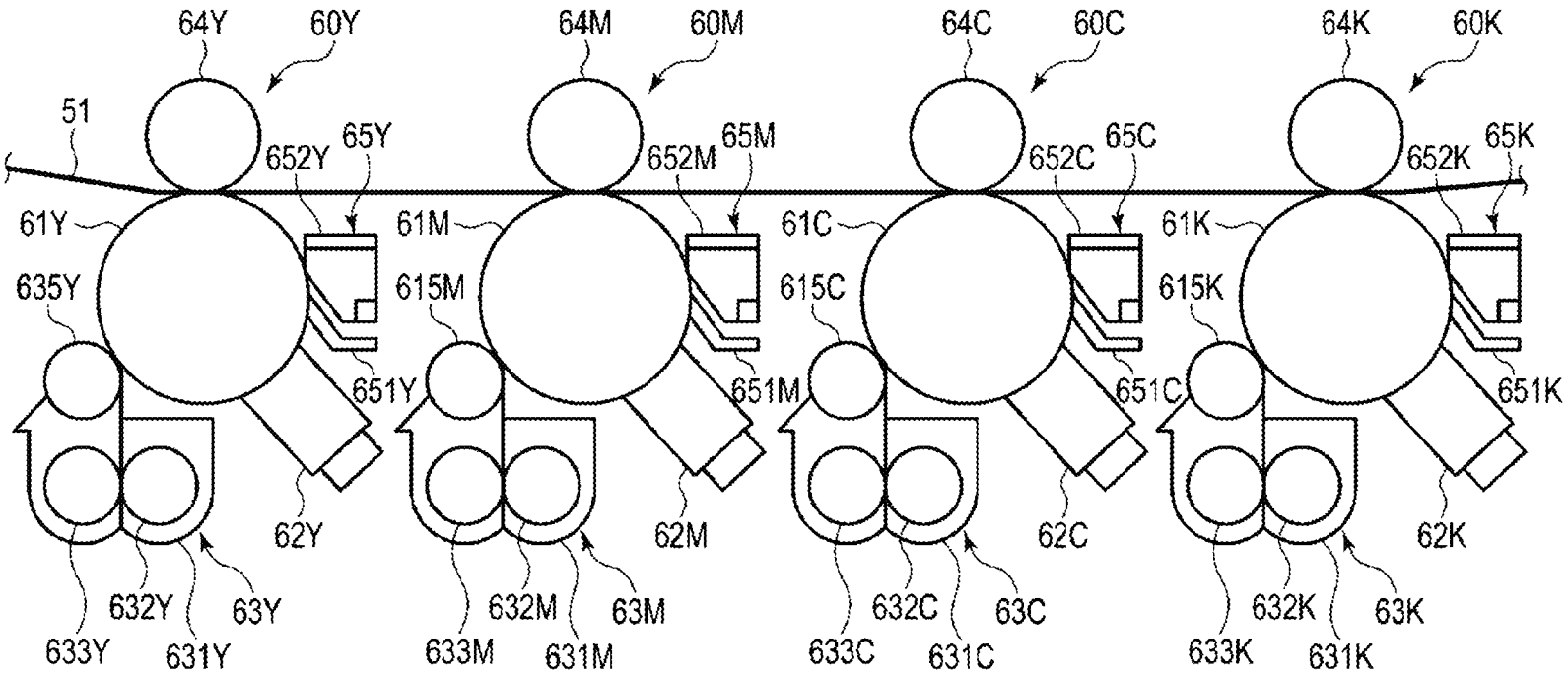
FIG. 2 schematically illustrates a cross-sectional view of an image forming unit included in the image forming apparatus.
Figure 3:
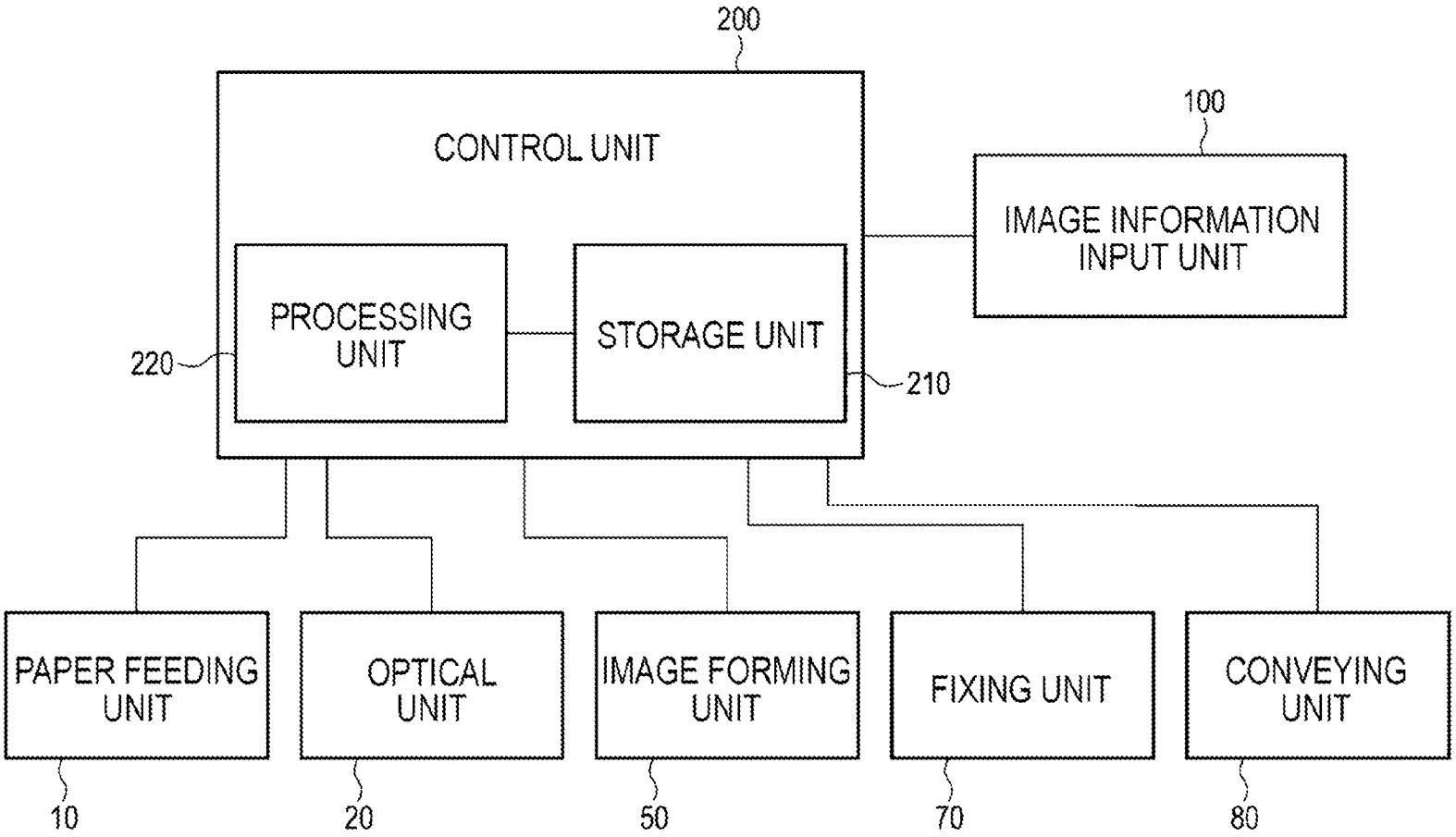
FIG. 3 is a block diagram illustrating a schematic configuration of a control system.
Figure 4:
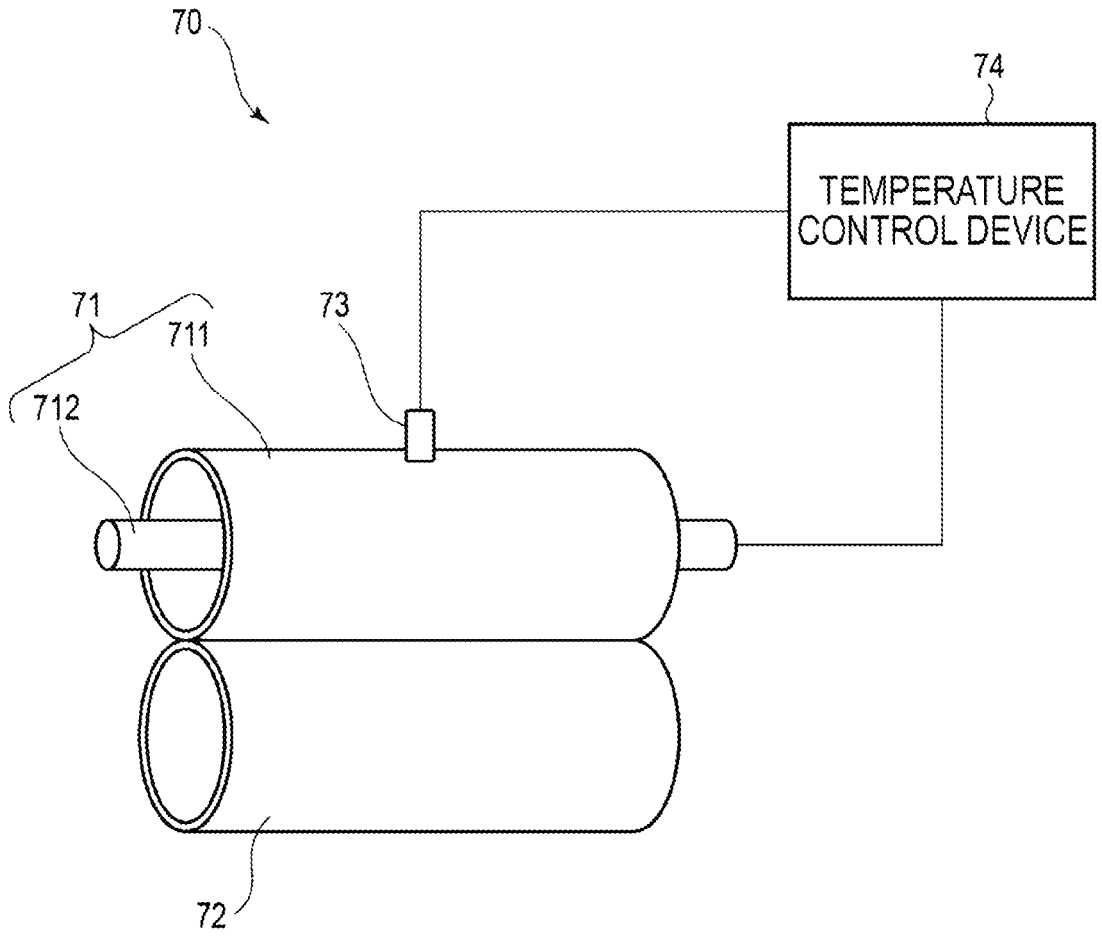
FIG. 4 schematically illustrates a perspective view of a fixing unit.

FIG. 1 schematically illustrates a cross-sectional view of an overall structure of an image forming apparatus according to an embodiment. FIG. 2 schematically illustrates a cross-sectional view of a structure of an image forming unit included in the image forming apparatus illustrated in FIG. 1. FIG. 3 is a block diagram illustrating a schematic configuration of a control system of the image forming apparatus illustrated in FIG. 1. FIG. 4 schematically illustrates a perspective view of a fixing unit included in the image forming apparatus illustrated in FIG. 1.

An image forming apparatus 1 illustrated in FIG. 1 is a color multifunctional peripheral (MFP). The image forming apparatus 1 includes a casing 2, a printer unit 3 installed in the casing 2, and a scanner unit 4 installed on an upper surface of the casing 2.

The printer unit 3 forms an image on a recording medium, here a sheet of paper or resin film, by electrophotography. The printer unit 3 includes a paper feeding unit 10, an optical unit 20, an image forming unit 50, a fixing unit 70, a conveying unit 80, an image information input unit 100, and a control unit 200.

The paper feeding unit 10 includes a plurality of paper feed cassettes 11 and a plurality of pickup rollers 12. These paper feed cassettes 11 accommodate stacked sheets. The pickup roller 12 feeds the uppermost sheet P among the sheets stored in the paper feed cassette 11 to the image forming unit 50.

The optical unit 20 exposes photoreceptors 61Y, 61M, 61C, and 61K, which will be described later, and forms an electrostatic latent image on the surface thereof. For the optical unit 20, for example, a laser or a light emitting diode (LED) can be used.

The image forming unit 50 includes an intermediate transfer belt 51, a plurality of rollers 52, a secondary transfer roller 54, a backup roller 55, image forming units 60Y, 60M, 60C, and 60K, hoppers 66Y, 66M, 66C, and 66K, and toner cartridges 67Y, 67M, 67C, and 67K. Primary transfer rollers 64Y, 64M, 64C and 64K, which will be described later, the intermediate transfer belt 51, the plurality of rollers 52, the secondary transfer roller 54, and the backup roller 55 constitute a transfer device.

The intermediate transfer belt 51 is an example of an intermediate transfer medium. The intermediate transfer belt 51 temporarily holds the toner images formed by the image forming units 60Y, 60M, 60C, and 60K. The plurality of rollers 52 apply tension to the intermediate transfer belt 51. The secondary transfer roller 54 drives the intermediate transfer belt 51. A part of the intermediate transfer belt 51 is interposed between the secondary transfer roller 54 and the backup roller 55. The backup roller 55 transfers the toner image formed on the intermediate transfer belt 51 to the sheet P together with the secondary transfer roller 54.

The image forming units 60Y, 60M, 60C, and 60K have the same structure. That is, as illustrated in FIG. 2, the image forming unit 60Y includes the photoreceptor 61Y, a charger 62Y, a developing unit 63Y, the primary transfer roller 64Y, and a cleaning unit 65Y. The image forming unit 60M includes the photoreceptor 61M, a charger 62M, a developing unit 63M, the primary transfer roller 64M, and a cleaning unit 65M. The image forming unit 60C includes the photoreceptor 61C, a charger 62C, a developing unit 63C, the primary transfer roller 64C, and a cleaning unit 65C. The image forming unit 60K includes the photoreceptor 61K, a charger 62K, a developing unit 63K, the primary transfer roller 64K, and a cleaning unit 65K.

Here, the photoreceptors 61Y, 61M, 61C, and 61K are photoreceptor drums. The photoreceptors 61Y, 61M, 61C, and 61K may be photoreceptor belts. According to one example, the photoreceptors 61Y, 61M, 61C, and 61K are organic photoreceptors.

The chargers 62Y, 62M, 62C, and 62K give negative charges to the photoreceptors 61Y, 61M, 61C, and 61K, respectively, and cause negative static electricity to be uniformly charged on the surfaces of the photoreceptors 61Y, 61M, 61C, and 61K.

The developing unit 63Y includes a developing container 631Y, developer mixers 632Y and 633Y, and a developing roller 635Y. The developer mixers 632Y and 633Y agitate a developer in the developing container 631Y and supply the developer to the developing roller 635Y. The developing roller 635Y supplies the developer to the photoreceptor 61Y.

The developing unit 63M includes a developing container 631M, developer mixers 632M and 633M, and a developing roller 635M. The developer mixers 632M and 633M agitate a developer in the developing container 631M and supply the developer to the developing roller 635M. The developing roller 635M supplies the developer to the photoreceptor 61M.

The developing unit 63C includes a developing container 631C, developer mixers 632C and 633C, and a developing roller 635C. The developer mixers 632C and 633C agitate a developer in the developing container 631C and supply the developer to the developing roller 635C. The developing roller 635C supplies the developer to the photoreceptor 61C.

The developing unit 63K includes a developing container 631K, developer mixers 632K and 633K, and a developing roller 635K. The developer mixers 632K and 633K agitate a developer in the developing container 631K and supply the developer to the developing roller 635K. The developing roller 635K supplies the developer to the photoreceptor 61K.

The developing units 63Y, 63M, 63C, and 63K supply developer to the photoreceptors 61Y, 61M, 61C, and 61K, respectively, to form toner images corresponding to the electrostatic latent images. One or two of the developing units 63Y, 63M, 63C and 63K can be omitted. The image forming unit 50 may further include one or more other developing units in addition to the developing units 63Y, 63M, 63C, and 63K. The developer and the toner will be described later in detail.

The primary transfer rollers 64Y, 64M, 64C and 64K transfer the toner images on the photoreceptors 61Y, 61M, 61C, and 61K to the intermediate transfer belt 51, respectively.

The cleaning units 65Y, 65M, 65C, and 65K remove residues on the photoreceptors 61Y, 61M, 61C, and 61K, respectively.

The cleaning unit 65Y includes a cleaning blade 651Y and a recovery tank 652Y. The cleaning blade 651Y is installed so that an edge thereof is in contact with the surface of the photoreceptor 61Y. A portion of the cleaning blade 651Y that contacts the photoreceptor 61Y is made of, for example, an organic polymer material. The cleaning blade 651Y removes a developer residue from the photoreceptor 61Y as the photoreceptor 61Y rotates. The residue removed by the cleaning blade 651Y is recovered by the recovery tank 652Y. The residue recovered by the recovery tank 652Y is discarded or reused in the developing unit 63Y.

The cleaning unit 65M includes a cleaning blade 651M and a recovery tank 652M. The cleaning blade 651M is installed so that an edge thereof is in contact with the surface of the photoreceptor 61M. A portion of the cleaning blade 651M that contacts the photoreceptor 61M is made of, for example, an organic polymer material. The cleaning blade 651M removes the developer residue from the photoreceptor 61M as the photoreceptor 61M rotates. The recovery tank 652M recovers the residue removed by the cleaning blade 651M. The residue recovered by the recovery tank 652M is discarded or reused in the developing unit 63M.

The cleaning unit 65C includes a cleaning blade 651C and a recovery tank 652C. The cleaning blade 651C is installed such that an edge thereof is in contact with the surface of the photoreceptor 61C. A portion of the cleaning blade 651C that contacts the photoreceptor 61C is made of, for example, an organic polymer material. The cleaning blade 651C removes the developer residue from the photoreceptor 61C as the photoreceptor 61C rotates. The recovery tank 652C recovers the residue removed by the cleaning blade 651C. The residue recovered by the recovery tank 652C is discarded or reused in the developing unit 63C.

The cleaning unit 65K includes a cleaning blade 651K and a recovery tank 652K. The cleaning blade 651K is installed such that an edge thereof is in contact with the surface of the photoreceptor 61K. A portion of the cleaning blade 651K that is in contact with the photoreceptor 61K is made of, for example, an organic polymer material. The cleaning blade 651K removes the developer residue from the photoreceptor 61K as the photoreceptor 61K rotates. The recovery tank 652K recovers the residue removed by the cleaning blade 651K. The residue recovered by the recovery tank 652K is discarded or reused in the developing unit 63K.

The hoppers 66Y, 66M, 66C, and 66K are installed above the developing units 63Y, 63M, 63C, and 63K, respectively. The hoppers 66Y, 66M, 66C and 66K replenish the developer to the developing units 63Y, 63M, 63C and 63K, respectively.

The toner cartridges 67Y, 67M, 67C, and 67K are installed above the hoppers 66Y, 66M, 66C, and 66K to be detachable and attachable, respectively. The toner cartridges 67Y, 67M, 67C, and 67K include toner cartridge main bodies 671Y, 671M, 671C, and 671K, respectively. Each of the toner cartridge main bodies 671Y, 671M, 671C, and 671K is an example of a container and contains the developer. The toner cartridges 67Y, 67M, 67C, and 67K supply the developer to the hoppers 66Y, 66M, 66C, and 66K, respectively.

As illustrated in FIG. 1, the fixing unit 70 is installed on a path where the conveying unit 80 conveys the sheet P and between the secondary transfer roller 54 and a paper discharge roller 83. The fixing unit 70 applies heat and pressure to the sheet P to which the toner image is transferred, and fixes the toner image on the sheet P.

As illustrated in FIG. 4, the fixing unit 70 includes a heating roller 71, a pressure roller 72, a temperature sensor 73, and a temperature control device 74.

The heating roller 71 is installed so as to contact a toner image provided on the sheet P when the sheet P passes through the fixing unit 70. The heating roller 71 heats the toner image on the sheet P when the sheet P passes through the fixing unit 70.

The heating roller 71 includes a roller main body 711 and a heat source 712.

According to an example, the roller main body 711 includes a metal cylindrical body and a coat layer covering the outer peripheral surface thereof. The coat layer is made of, for example, silicone rubber or fluororesin.

The heat source 712 heats the roller main body 711. The heat source 712 heats the roller main body 711 by, for example, radiation or induction heating. As the heat source 712, for example, a halogen lamp or a coil is used.

The pressure roller 72 is installed such that the outer peripheral surface thereof faces the outer peripheral surface of the heating roller 71. The pressure roller 72 applies pressure to the sheet P passing between the heating roller 71 and the pressure roller 72 and the toner image thereon.

The temperature sensor 73 detects a temperature of the heating roller 71, for example, the temperature of the outer peripheral surface of the heating roller 71. According to an example, the temperature sensor 73 includes a thermistor that contacts the heating roller 71 and detects the temperature of the heating roller 71. The thermistor is installed so as to be in contact with the outer peripheral surface of the heating roller 71, for example.

The temperature control device 74 is electrically connected to the heat source 712 and the temperature sensor 73. The temperature control device 74 includes a power supply and a processor. The power supply supplies power to the heat source 712. The processor controls the supply of power from the power supply to the heat source 712 so that the temperature detected by the temperature sensor 73 becomes equal to a set value. An operation described above regarding the processor can be performed by the control unit 200 described later.

The conveying unit 80 includes a registration roller 81, a conveyance roller 82, the paper discharge roller 83, and a paper discharge tray 84. The registration roller 81 starts conveyance of the sheet P fed out from the pickup roller 12 to the image forming unit 50 at a predetermined timing. The conveyance roller 82 conveys the sheet P fed out from the registration roller 81 so that the sheet P passes between the backup roller 55 and the intermediate transfer belt 51 and then passes through the fixing unit 70. The paper discharge roller 83 is positioned on the path for conveying the sheet P and immediately before the sheet P is discharged outside the printer unit 3, and conveys the sheet P toward the paper discharge tray 84. The paper discharge tray 84 is positioned on the upper surface of the printer unit 3 and receives the discharged sheet P.

The image information input unit 100 takes in image information to be printed on the sheet P as a recording medium from an external recording medium or a network. The image information input unit 100 supplies this image information to the control unit 200.

The control unit 200 includes a storage unit 210 and a processing unit 220. The storage unit 210 includes, for example, a primary storage device (for example, random access memory (RAM)) and a secondary storage device (for example, ROM (read only memory)). The processing unit 220 includes a processor (for example, central processing unit (CPU)). The secondary storage device stores, for example, a program that is interpreted and executed by the processor. The primary storage device primarily stores, for example, image information supplied by the image information input unit 100 and the like, a program stored in the secondary storage device, data generated by the processor through arithmetic processing, and the like. The processor interprets and executes the program stored in the primary storage device. In this way, the control unit 200 controls the operations of the paper feeding unit 10, the optical unit 20, the image forming unit 50, the fixing unit 70, the conveying unit 80, and the like based on the image information supplied from the image information input unit 100 or the like.

2. DEVELOPER

Next, a developer that can be used in the image forming apparatus 1 will be described.

In the image forming apparatus 1 described with reference to FIGS. 1 to 4, for example, a two-component developer containing a toner and a carrier can be used as the developer.

Although the carrier is not particularly limited, for example, a ferrite carrier can be used.

The toner cartridges 67Y, 67M, 67C, and 67K contain toners having different colors. Here, as an example, the toner cartridges 67Y, 67M, 67C, and 67K contain yellow, magenta, cyan, and black toners, respectively.

These toners may be distributed to a market individually or as a toner set including the toners. In this toner set, the toners having different colors are stored in separate containers.

In the toner set, each of the toners may not be mixed with the carrier and may be mixed with the carrier. In the latter case, these toners may be distributed using, for example, the toner cartridge main bodies 671K and 671Y as the containers of the toners. That is, these toners may be distributed in the form of a toner cartridge set. The container for storing the toner during distribution thereof may be a container other than the toner cartridge main body.

2.1. Toner Particle

The toner contains a plurality of toner particles.

An average particle diameter of the toner particles is preferably in the range of 5.0 to 10.0 μm, and more preferably in the range of 6.0 to 9.0 μm. Here, in this context, the average particle diameter of the toner particles is taken as a volume-based median diameter ($D_{50}$) obtained by measurement by an electric detection band method (Coulter Principle-Based Method).

If the average particle diameter is too small, it may become difficult to control chargeability, and it may become difficult to achieve sufficient image quality under any environment such as low temperature and low humidity environment or high temperature and high humidity environment. If the average particle diameter is increased, a decrease in image quality and an increase in toner consumption may be caused.

The toner particles contain a colorant, non-crystalline polyester, and crystalline polyester.

Colorant

As the colorant, a pigment or a dye made of organic or inorganic substances can be used. Examples of the pigment or dye include Fast Yellow G, Benzidine Yellow, Indian Fast Orange, Irgadine Red, Carmine FB, Permanent Bordeaux FRR, Pigment Orange R, Lithol Red 2G, Lake Red C, Rhodamine FB, Rhodamine B Lake, Phthalocyanine Blue, Pigment Blue, Brilliant Green B, Phthalocyanine Green, or quinacridone. As the colorant, one of these may be used alone, or a mixture of two or more of these may be used.

As the colorant, carbon black can also be used, for example. As carbon black, for example, acetylene black, furnace black, thermal black, channel black, or ketjen black can be used.

The amount of the colorant is preferably within a range of 3.0 to 10.0 parts by mass, more preferably in the range of 4.0 to 8.0 parts by mass with respect to 100 parts by mass in total of the crystalline polyester and the non-crystalline polyester.

Binder Resin

In this toner, the non-crystalline polyester and the crystalline polyester (hereinafter, collectively referred to as polyester-based resin) are binder resin.

Here, the polyester having a ratio (softening point/melting temperature) between the softening point and the melting temperature of 0.9 to 1.1 is the crystalline polyester, and the other is non-crystalline polyester.

The softening point is measured using an elevated flow tester. The elevated flow tester has a piston with a cross-sectional area of 1 $cm^2$ for storing a sample. The sample is put into the piston and the temperature is raised by 2.5° C.

per minute while applying a 10 kgf load on the piston. When the temperature becomes a certain temperature or more, the sample starts to flow out of the flow tester. After the sample reaches a constant temperature and starts to flow out, the lowering amount of the piston increases as the temperature of the sample increases. The softening point is the temperature when the position of the piston drops 6 mm from the start of outflow.

The melting temperature is an endothermic peak temperature in a differential scanning calorimeter. The melting point of the crystalline polyester means this melting temperature.

As the polyester-based resin, those obtained by polycondensation using a divalent or higher alcohol component and a divalent or higher carboxylic acid component such as carboxylic acid, carboxylic acid anhydride, and carboxylic acid ester as a raw material monomer can be used, for example.

As the divalent or higher carboxylic acid component, for example, aromatic dicarboxylic acids such as terephthalic acid, phthalic acid, isophthalic acid; or aliphatic carboxylic acids such as fumaric acid, maleic acid, succinic acid, adipic acid, sebacic acid, glutaric acid, pimelic acid, oxalic acid, malonic acid, citraconic acid, and itaconic acid can be used.

As the divalent or higher carboxylic acid component, for example, aliphatic diols such as ethylene glycol, propylene glycol, 1,4-butanediol, 1,3-butanediol, 1,5-pentanediol, 1,6-hexanediol, neopentine glycol, trimethylene glycol, trimethylolpropane, and pentaerythritol; alicyclic diols such as 1,4-cyclohexanediol, and 1,4-cyclohexanedimethanol; ethylene oxide such as bisphenol A; or propylene oxide adducts can be used.

The polyester component may be made into a crosslinked structure by using 1,2,4-benzenetricarboxylic acid (trimellitic acid), or trivalent or higher polyvalent carboxylic acid such as glycerin, or polyhydric alcohol component. Further, as the binder resin, a mixture of two or more kinds of polyester resins having different compositions may be used.

The crystalline polyester is preferably a polycondensation product of one or more alcohol components selected from aliphatic diols having 2 to 16 carbon atoms and one or more carboxylic acid components selected from aliphatic dicarboxylic acid-based compounds having 4 to 14 carbon atoms.

The crystalline polyester has a melting point in the range of 80 to 110° C. The melting point of the crystalline polyester is preferably in the range of 90 to 100° C. When the melting point of the crystalline polyester is low, high temperature offset is likely to occur. When the melting point of the crystalline polyester is high, low temperature offset is likely to occur.

The non-crystalline polyester is preferably a polycondensation product of one or more alcohol components selected from aliphatic diols having 2 to 4 carbon atoms having a hydroxyl group bonded to a secondary carbon atom and one or more carboxylic acid components selected from a group consisting of aromatic dicarboxylic acid-based compounds, aliphatic dicarboxylic acid-based compounds, and trivalent or higher carboxylic acid-based compounds. Aliphatic diols having 2 to 4 carbon atoms having a hydroxyl group bonded to a secondary carbon atom include, for example, 1,2-propanediol, 1,2-butanediol, 1,3-butanediol, and 2,3-butanediol.

The non-crystalline polyester preferably has a softening point in the range of 100 to 140° C., and more preferably in the range of 110 to 130° C.

When polymerizing raw material monomers to synthesize non-crystalline polyester, for the purpose of promoting the reaction, esterification catalysts such as dibutyltin oxide, titanium compounds, dialkoxy tin (II), tin oxide (II), fatty acid tin (II), dioctanoic acid tin (II), and distearate tin (II) used in esterification reaction can be used. On the other hand, when the raw material monomer is polymerized in order to synthesize the crystalline polyester, no esterification catalyst is used.

A ratio of the total amount of crystalline polyester and non-crystalline polyester to the amount of toner particles is preferably in the range of 70 to 95% by mass, and more preferably in the range of 80 to 90% by mass.

The amount of the crystalline polyester is preferably in the range of 5 to 20 parts by mass, more preferably in the range of 10 to 15 parts by mass with respect to 100 parts by mass of the non-crystalline polyester. When the amount of the crystalline polyester is reduced, low temperature offset resistance is lowered. When the amount of the crystalline polyester is increased, the storage stability under high temperature environment deteriorates.

The gel content of the toner particles is in the range of 4 to 11% by mass. Here, the "gel content of toner particles" is obtained by the following method.

Approximately 0.5 g of toner particles are weighed into a 100 mL Erlenmeyer flask (A(g)), and 50 mL of tetrahydrofuran (THF) is added to dissolve polyester resin of the toner particles in THF.

Separately, Celite 545 is tightly filled into the glass filter from six tenth (6/10) to 7 tenth (7/10), and after drying sufficiently, the dried glass filter is weighed (B (g)).

Next, the THF solution in which the polyester resin is dissolved is transferred into a dried glass filter and suction filtered. Specifically, all the contents remaining on the wall of the Erlenmeyer flask are transferred into a glass filter using acetone, acetone is allowed to flow through the glass filter to drop the soluble component into a suction bottle, and suction is continued so that no solvent remains in the glass filter. Thereafter, the glass filter is sufficiently dried with a vacuum dryer, and the dried glass filter is weighed (C(g)).

The gel fraction (THF insoluble content) is calculated according to the following expression.

$$\text{Gel fraction (\% by mass)} = (C-B)/A \times 100$$

This gel content is preferably in the range of 4 to 11% by mass. When this gel content is reduced, the storage stability and high temperature offset resistance of the toner particles deteriorate. When this gel content is increased, the low temperature offset resistance of the toner particles is lowered. As a result, the surface of the heating roller of the fixing unit is damaged, and problems such as generation of streak images are likely to occur.

The binder resin may further contain resin other than polyester-based resin. As such resin, for example, styrene acrylic-based resin, polyurethane-based resin, or epoxy-based resin can be used. The amount of the resin other than the polyester-based resin is preferably 20 parts by mass or less, and more preferably 10 parts by mass or less, with respect to a total of 100 parts by mass of the crystalline polyester and the non-crystalline polyester.

Release Agent

The toner particles may further contain a release agent. As the release agent, for example, low molecular weight polyethylene, low molecular weight polypropylene; polyolefin copolymer; aliphatic hydrocarbon waxes such as polyolefin wax, microcrystalline wax, paraffin wax, and Fischer-Tropsch wax, or modified products thereof; oxides of aliphatic hydrocarbon waxes such as oxidized polyethylene wax or block copolymers thereof; plant waxes such as candelilla wax, carnauba wax, wood wax, jojoba wax, and rice wax;

animal waxes such as beeswax, lanolin, and whale wax; mineral waxes such as montan wax, ozokerite, ceresin, and petrolactam; waxes based on fatty acid esters such as montanic acid ester wax and castor wax; or a product obtained by deoxidizing a part or all of a fatty acid ester such as deoxidized carnauba wax can be used. The release agent may be omitted.

When a release agent is used, the amount thereof is preferably in the range of 2 to 20 parts by mass, more preferably in the range of 4 to 15 parts by mass with respect to 100 parts by mass of the toner particles.

Charge Control Agent

The toner particles may further contain a charge control agent. As the charge control agent, for example, a metal-containing azo compound can be used. The metal-containing azo compound is, for example, a complex or complex salt whose metal element is iron, cobalt, or chromium. As the metal-containing azo compound, one of the complex and the complex salt may be used alone, or two or more of the complex and the complex salt may be used. As the charge control agent, for example, a metal-containing salicylic acid derivative compound can be used. The metal-containing salicylic acid derivative compound is, for example, a complex or complex salt whose metal element is zirconium, zinc, chromium, or boron. As the metal-containing salicylic acid derivative compound, one of the complex and the complex salt may be used alone, or two or more of the complex and the complex salt may be used. The charge control agent may be omitted.

When the charge control agent is used, the amount thereof is preferably in the range of 0.1 to 2 parts by mass, and more preferably in the range of 0.2 to 1.5 parts by mass with respect to 100 parts by mass of the toner particles.

2.2 External Additive

The toner may further contain an external additive. Inorganic fine particles.

As the external additive, for example, inorganic fine particles can be used. It is advantageous to externally add the inorganic fine particles to toner particles in order to adjust fluidity and chargeability of the toner.

As the inorganic fine particles, for example, fine particles such as silica, titania (titanium oxide), strontium titanate, or tin oxide can be used. As the inorganic fine particles, one of the silica, titania, strontium titanate, or tin oxide may be used alone, or two or more thereof may be used.

It is preferable to use inorganic fine particles that are surface-treated with a hydrophobizing agent. As such inorganic fine particles, for example, hydrophobic silica particles can be used. By using inorganic fine particles surface-treated with the hydrophobizing agent, better environmental stability can be achieved.

An average particle diameter of the inorganic fine particles is preferably 500 nm or less, and more preferably in the range of 2 nm to 500 nm. Here, in this context, the average particle diameter of the inorganic fine particles is considered a number-based median diameter obtained by measurement by a laser diffraction method.

When inorganic fine particles are used, the amount thereof is preferably in the range of 1 to 10 parts by mass, and more preferably in the range of 2 to 8 parts by mass with respect to 100 parts by mass of the toner particles.

Resin Fine Particle

The toner may further contain resin fine particles supported on the surface of the toner particles instead of or in addition to the inorganic fine particles.

An average particle diameter of the resin fine particles is preferably 200 nm or more, and more preferably in the range of 200 nm to 3 μm. Here, in this context, the average particle diameter of the resin fine particles is considered a volume-based median diameter (volume median diameter) obtained by measurement by a laser diffraction method.

When resin fine particles are used, the amount thereof is preferably in the range of 0.1 to 2 parts by mass, and more preferably in the range of 0.2 to 1 parts by mass with respect to 100 parts by mass of the toner particles.

Cleaning Aid

A cleaning aid may be externally added to the toner particles. The cleaning aid is an abrasive particle, a fatty acid metal salt, or a combination thereof. Preferably, the cleaning aid contains abrasive particles as one component and an aliphatic metal salt as the remaining component.

As the abrasive particles, for example, inorganic particles such as inorganic dielectric particles can be used. As the abrasive particles, alumina particles are preferably used because of influence of the alumina particles on cleaning performance and charging characteristics.

The abrasive particles have a larger average particle diameter compared to the inorganic fine particles described above. The average particle diameter of the abrasive particles is preferably 0.2 μm or more, and more preferably in the range of 0.4 to 3 μm. Here, in this context, the average particle diameter of the abrasive particles is taken as a number-based median diameter obtained by measurement by a laser diffraction method.

As the fatty acid metal salt, for example, zinc stearate, calcium stearate, zinc laurate, or a combination thereof can be used.

3. IMAGE FORMING METHOD

Next, an image forming method according to an embodiment will be described.

The image forming method according to the embodiment includes irradiating the photoreceptor with light to form an electrostatic latent image, supplying a developer to the photoreceptor on which an electrostatic latent image is formed to form a toner image corresponding to the electrostatic latent image, and directly or indirectly transferring the toner image from the photoreceptor onto a recording medium. As the developer, those developers described above are used.

Hereinafter, as an example, an image forming method using the image forming apparatus 1 described with reference to FIGS. 1 to 4 will be described.

First, an operator inputs information about an image to be formed on the sheet P to the image information input unit 100 through, for example, a network or from an external recording medium. The image information may be input by reading an image with the scanner unit 4.

The image information input unit 100 outputs this image information to the control unit 200. Based on this image information, the control unit 200 controls the operations of the paper feeding unit 10, the optical unit 20, the image forming unit 50, the fixing unit 70, the conveying unit 80, and the like as follows.

First, the control unit 200 controls the operation of the paper feeding unit 10 so that one pickup roller 12 feeds the uppermost sheet P among the sheets stored in the paper feeding cassette 11 corresponding to the pickup roller 12 to the registration roller 81.

The control unit 200 controls the optical unit 20 and the image forming unit 50 so as to perform the following operations.

The secondary transfer roller 54, which is a driving roller, causes the intermediate transfer belt 51 to rotate counterclockwise in FIG. 1. The photoreceptors 61Y, 61M, 61C, and 61K rotate clockwise in FIG. 1. The chargers 62Y, 62M, 62C, and 62K uniformly charge the surfaces of the photoreceptors 61Y, 61M, 61C, and 61K, respectively. The optical unit 20 forms a first electrostatic latent image corresponding to a yellow pattern in the image information on the surface of the photoreceptor 61Y. The optical unit 20 forms a second electrostatic latent image corresponding to a magenta pattern in the image information on the surface of the photoreceptor 61M. The optical unit 20 forms a third electrostatic latent image corresponding to a cyan pattern in the image information on the surface of the photoreceptor 61C. Furthermore, the optical unit 20 forms a fourth electrostatic latent image corresponding to a black pattern in the image information on the surface of the photoreceptor 61K.

The developing unit 63Y forms a first toner image corresponding to the first electrostatic latent image on the surface of the photoreceptor 61Y. The developing unit 63M forms a second toner image corresponding to the second electrostatic latent image on the surface of the photoreceptor 61M. The developing unit 63C forms a third toner image corresponding to the third electrostatic latent image on the surface of the photoreceptor 61C. The developing unit 63K forms a fourth toner image corresponding to the fourth electrostatic latent image on the surface of the photoreceptor 61K. The primary transfer rollers 64Y, 64M, 64C and 64K transfer the toner images from the photoreceptors 61Y, 61M, 61C, and 61K onto the intermediate transfer belt 51, respectively.

The control unit 200 controls the operations of the optical unit 20 and the image forming unit 50 so that the relative positions of the first to fourth toner images coincide with the relative positions of the yellow, cyan, magenta, and black patterns in the image information on the intermediate transfer belt 51.

The control unit 200 controls the operations of the image forming unit 50 and the conveying unit 80 so that the sheet P passes between the intermediate transfer belt 51 and the backup roller 55 and the first to fourth toner images on the intermediate transfer belt 51 are transferred onto the sheet P when the portion of the intermediate transfer belt 51 that supports the first to fourth toner images passes through the secondary transfer roller 54.

Thereafter, the control unit 200 controls the operations of the fixing unit 70 and the conveying unit 80 so that the first to fourth toner images are fixed on the sheet P and then the sheet P is discharged onto the paper discharge tray 84.

Specifically, during printing, the control unit 200 controls the temperature of the heating roller 71, particularly the temperature of the outer peripheral surface of the heating roller 71, to be equal to the first set value. For example, the control unit 200 controls the temperature of the heating roller 71 during printing within a range of 140 to 180° C. During printing, the temperature control device 74 controls the supply of power from the power source to the heat source 712 so that the temperature detected by the temperature sensor 73 is equal to the first set value.

The control unit 200 controls the temperature of the heating roller 71 during standby, particularly the temperature of the outer peripheral surface of the heating roller 71, to a temperature that is 10 to 50° C. lower than the temperature of the heating roller 71 during printing. For example, the control unit 200 controls the temperature of the heating roller 71 during standby, particularly the temperature of the outer peripheral surface of the heating roller 71, to be equal to a second set value that is 10 to 50° C. lower than the first set temperature. During standby, the temperature control device 74 controls the supply of power from the power source to the heat source 712 so that the temperature detected by the temperature sensor 73 is equal to the second set value.

A printed matter is obtained by doing as described above.

4. EFFECT

As described above, when crystalline polyester is used in the toner particles, the toner particles can be fixed at a low temperature. However, as described above, the toner in the related art using crystalline polyester in the toner particles generally has low storage stability. The toner in the related art using the crystalline polyester in the toner particles generally tends to have a low viscosity when melted and has low high temperature offset resistance.

The toner may adhere to a member that contacts the outer peripheral surface of the heating roller, such as a thermistor. In the toner in the related art using the crystalline polyester in the toner particles, a hardened product with high hardness is produced when the toner in the related art is heated for a long time.

During printing, even if toner adheres to the member that contacts the outer peripheral surface of the heating roller, the toner quickly detaches from the previous member. However, if a standby state is long, the toner adhering to the member in contact with the outer peripheral surface of the heating roller is heated for a long time, and a hardened product with high hardness is produced.

When such a hardened product is produced on the member in contact with the outer peripheral surface of the heating roller, the outer peripheral surface may be damaged in a streak pattern as the heating roller rotates. When the outer peripheral surface of the heating roller is flawed by the hardened product, the toner enters the flaw. As a result, for example, a stripe image is generated.

In contrast, the toner according to the embodiment is excellent in storage stability and high temperature offset resistance despite being capable of fixing at a low temperature. In the toner according to the embodiment, a hardened product with high hardness is hardly generates even if the toner is heated for a long time. Therefore, damage to the outer peripheral surface of the heating roller due to curing of the toner hardly occurs, and therefore, a stripe image or the like is hardly generated. This is considered to be due to the following reason.

As described above, the toner using crystalline polyester in the toner particles to lower the melting point tends to have a low viscosity at the time of melting. When the gel content of the toner particles is increased, the viscosity of the toner at the time of melting increases.

However, the toner particles with large gel content have high polyester reactivity. Therefore, the toner containing such toner particles undergoes further polycondensation when heated for a long time. As a result, a hardened product with high hardness is produced.

In the toner according to the embodiment, the toner particles contain non-crystalline polyester and crystalline polyester. Crystalline polyester does not contain an esterification catalyst. In the toner particles, the non-crystalline polyester and the crystalline polyester are not uniformly mixed, and even when the toner is melted, the non-crystalline polyester and the crystalline polyester are not uniformly mixed. Therefore, even when the toner according to the exemplary embodiment is heated for a long time, further polycondensation hardly occurs.

In the toner according to the exemplary embodiment, the esterification catalyst is not supplied from the crystalline polyester to the non-crystalline polyester. Therefore, in the non-crystalline polyester, polycondensation due to an increase in the esterification catalyst is not promoted.

If the melting point of the crystalline polyester and the gel content of the toner are within the predetermined ranges, excellent storage stability can be achieved without impairing the offset resistance.

Accordingly, the toner according to the embodiment is excellent in storage stability and high temperature offset resistance despite being capable of fixing at a low temperature, and hardly produces a hardened product with high hardness even when heated for a long time.

5. MODIFICATION EXAMPLE

The image forming apparatus 1 described above includes the intermediate transfer belt 51 as an intermediate transfer medium, but may include an intermediate transfer roller instead of the intermediate transfer belt 51.

The image forming apparatus 1 performs transfer via an intermediate transfer medium. That is, the image forming apparatus 1 indirectly transfers the toner image from the photoreceptors 61Y, 61M, 61C, and 61K onto the sheet P. The image forming apparatus 1 may directly transfer the toner image from the photoreceptors 61Y, 61M, 61C, and 61K onto the sheet P. That is, the image forming apparatus 1 may be a direct transfer type image forming apparatus.

In the image forming apparatus 1, four image forming units 60Y, 60M, 60C, and 60K are disposed, but the number of image forming units may be one or more.

In the image forming apparatus 1, the toner cartridges 67Y, 67M, 67C, and 67K are installed above the hoppers 66Y, 66M, 66C, and 66K to be detachable and attachable, respectively, but may have the following form. For example, the image forming apparatus 1 may include the toner cartridges 67Y, 67M, 67C, and 67K integrally with the developing units 63Y, 63M, 63C, and 63K, respectively, and may include the units in a detachable manner. Alternatively, the image forming apparatus 1 includes the toner cartridges 67Y, 67M, 67C, and 67K integrally with the developing units 63Y, 63M, 63C, and 63K and the photoreceptors 61Y, 61M, 61C, and 61K, respectively, and may include the units in a detachable manner.

EXAMPLES

Examples are described below.

Evaluation and measurement method

First, the evaluation and measurement method will be described.

Melting Point

The melting point was measured using a differential scanning calorimeter (DSC Q20A manufactured by PerkinElmer) under the following conditions.

Measurement start temperature: 20° C.

Temperature rising rate: 10° C./min

Measurement end temperature: 180° C.

Softening point

The softening point as measured using the elevated flow tester. The elevated flow tester has a piston with a cross-sectional area of 1 $cm^2$ for storing a sample. The sample was put into the piston and the temperature was raised by 2.5° C. per minute while applying a 10 kgf load on the piston. When the temperature became a certain temperature or more, the sample started to flow out of the flow tester. The softening point is the temperature when the piston position dropped 6 mm from the start of outflow.

Gel Content

Approximately 0.5 g of toner particles were weighed into a 100 mL Erlenmeyer flask (A(g)), and 50 mL of tetrahydrofuran (THF) was added to dissolve polyester resin of the toner particles in THF.

Separately, Celite 545 was tightly filled into the glass filter from six tenth (6/10) to seven tenth (7/10), and after drying sufficiently, the dried glass filter was weighed (B(g)).

Next, the THF solution in which the polyester resin was dissolved was transferred into a dried glass filter and suction filtered. Specifically, all the contents remaining on the wall of the Erlenmeyer flask were transferred into a glass filter using acetone, acetone was allowed to flow through the glass filter to drop the soluble component into a suction bottle, and suction was continued so that no solvent remains in the glass filter. Thereafter, the glass filter was sufficiently dried with a vacuum dryer, and the dried glass filter was weighed (C(g)).

The gel fraction (THF insoluble content) was calculated according to the following expression.

$$\text{Gel fraction (\% by mass)}=(C-B)/A\times 100$$

Storage Stability 20 g of toner was put into a polymer bottle with a volume of 100 mL. The 20 g of toner was left in an environment of 55° C. for 8 hours, and then slowly cooled. Next, a powder tester manufactured by Hosokawa Micron Corporation was used to check the degree of toner aggregation. Here, the total amount of toner put in the bottle was used. A 60 mesh sieve was used, the amplitude is 1 mm, and the vibration time was 10 seconds. The amount of toner remaining on the sieve was evaluated in light of the following criteria to evaluate storage stability of the toner.

0.5 g or less: AA

More than 0.5 g and less than 1.0 g: A 1.0 g or more: B

Heat resistance modification

First, viscosity of the toner according to the temperature was measured. For the measurement of the viscosity, an ARES rheometer manufactured by TA-Instruments was used. Here, the measurement time was 30 minutes and the measurement temperature was 160° C.

Next, the toner was left in an environment of 160° C. for 24 hours, and then the viscosity measurement described above was performed again. The difference between the temperature at which the viscosity became $1.0\times10^5$ Pa·s after being left in an environment of 160° C. and the temperature at which the viscosity became $1.0\times10^5$ Pa·s before being left in an environment of 160° C. was calculated. Hereinafter, this difference is referred to as an "increase in temperature at which the viscosity becomes $1.0\times10^5$ Pa·s".

Returning Time

As the image forming apparatus, e-STUDIO® 5008A manufactured by Toshiba Tec Corporation was used. First, the temperature of the outer peripheral surface of the heating roller was lowered from the first set value that is the temperature during printing to the second set value that is the temperature during standby. Next, the heating roller 71 was heated from this state, and the time required for the outer peripheral surface temperature to reach the first set value was measured. The measured time was evaluated in light of the following criteria to evaluate the returning time.

Less than 10 seconds: AA 10 seconds or more and less than 17 seconds: A 17 seconds or more: B Durability As the image forming apparatus, e-STUDIO® 5008A manufactured by Toshiba Tec Corporation was used. Then, printing was repeated with a printing rate of 8%. The durability of the heating roller was evaluated in light of the following criteria for the number of printed sheets until the outer peripheral surface of the heating roller is damaged.

More than $450\times10^3$ sheets: AA

More than $330\times10^3$ sheets and $450\times10^3$ sheets or less: A $330\times10^3$ sheets or less: B Low temperature offset resistance As the image forming apparatus, e-STUDIO® 5008A manufactured by Toshiba Tec Corporation was used. Printing is performed by changing the temperature of the outer peripheral surface of the heating roller during printing, and the low temperature offset resistance was evaluated in light of the maximum temperature at which the low temperature offset occurs according to the following criteria.

Below 120° C.: AA

120° C. or more to 130° C. or less: A

Above 130° C.: B

High temperature offset resistance

As the image forming apparatus, e-STUDIO® 5008A manufactured by Toshiba Tec Corporation was used. Printing was performed by changing the temperature of the outer peripheral surface of the heating roller during printing, and the high temperature offset resistance was evaluated in light of the minimum temperature at which the high temperature offset occurs according to the following criteria.

Above 200° C.: AA

190° C. or more to 200° C. or less: A

Below 190° C.: B

Comprehensive evaluation

The comprehensive evaluation for an example in which all evaluations of the storage stability, the durability, the low temperature offset resistance, and the high temperature offset resistance were AA or A was defined as A. The comprehensive evaluation for an example in which one or more evaluations of the storage stability, the durability, the low temperature offset resistance, and the high temperature offset resistance were B was defined as B.

Test Example

Next, a test procedure and results are described below.

Example 1

The following materials were sufficiently mixed with a Henschel mixer. A blending ratio of these materials was as follows:

| | |
|---|---|
| Crystalline polyester resin PEa | 10 parts by mass |
| Non-crystalline polyester resin PEA | 79 parts by mass |
| Ester wax | 6 parts by mass |
| Colorant | 5 parts by mass |

Here, the crystalline polyester resin PEa was obtained by polycondensation of an alcohol component and a carboxylic acid component without an esterification catalyst, and had a melting point of 95° C. and a gel content of 0%. The non-crystalline polyester resin PEA was obtained by polycondensation of an alcohol component and a carboxylic acid component using a titanium compound as an esterification catalyst, and had a softening point of 120° C. and a gel content of 10% by mass. As the ester wax, WEP-8 manufactured by Nissan Electol was used. As the colorant, carbon black #44 manufactured by Mitsubishi Chemical Corporation was used.

Next, this mixture was melt-kneaded with a twin-screw extruder. After cooling the melt-kneaded mixture, the melt-kneaded mixture was pulverized and classified. By doing as described above, toner particles having an average particle diameter of 8.5 μm were obtained. The above-described Coulter principle-based method was sued to measure average particle diameter for the toner particles.

Next, toner particles and external additives were mixed to obtain a toner. As the external additives, hydrophobic silica and titanium oxide were used. The hydrophobic silica content of the toner was 1.5% by mass, and the titanium oxide content of the toner was 0.4% by mass.

For this toner, the gel content was measured. As a result, the gel content of this toner was 8% by mass.

Next, for this toner, the storage stability were evaluated. As a result, the amount of toner remaining on the sieve was 0.6 g, and sufficient storage stability could be achieved.

For this toner, heat resistance modification was evaluated. As a result, an increase in temperature at which the viscosity became $1.0\times10^5$ Pa·s was 25° C., and the heat resistance modification was sufficient.

The returning time was measured by setting the first set value, which is the temperature during printing, to 160° C. and the second set value, which is the temperature during standby, to 130° C. As a result, the returning time was 12 seconds.

Furthermore, printing using the toner described above was performed, and durability, low temperature offset resistance, and high temperature offset resistance were evaluated. Here, the first and second set values are as described above. As a result, the number of printed sheets until the outer peripheral surface of the heating roller was damaged was $390\times10^3$, and sufficient durability could be achieved. The maximum temperature that caused the low temperature offset was 125° C., and sufficient low temperature offset resistance could be achieved. The minimum temperature at which high temperature offset occurred was 195° C., and sufficient high temperature offset resistance could be achieved.

Example 2

The following materials were sufficiently mixed with a Henschel mixer. A blending ratio of these materials was as follows:

| | |
|---|---|
| Crystalline polyester resin PEb | 10 parts by mass |
| Non-crystalline polyester resin PEB | 79 parts by mass |
| Ester wax | 6 parts by mass |
| Colorant | 5 parts by mass |

Here, the crystalline polyester resin PEb was obtained by polycondensation of an alcohol component and a carboxylic acid component without an esterification catalyst, and had a melting point of 95° C. and a gel content of 0%. The non-crystalline polyester resin PEB was obtained by polycondensation of an alcohol component and a carboxylic acid component using a titanium compound as an esterification catalyst, and had a softening point of 110° C. and a gel content of 5% by mass. As the ester wax and the colorant, the same ester wax and colorant as in Example 1 were used.

Next, this mixture was melt-kneaded with a twin-screw extruder. After cooling the melt-kneaded mixture, the melt-kneaded mixture was pulverized and classified. By doing as described above, toner particles having an average particle diameter of 8.5 μm were obtained.

Next, toner particles and external additives were mixed to obtain a toner. The external additive and the amount thereof were the same as in Example 1.

For this toner, the gel content was measured. As a result, the gel content of this toner was 4% by mass.

Next, for this toner, the storage stability were evaluated. As a result, the amount of toner remaining on the sieve was 0.8 g, and sufficient storage stability could be achieved.

For this toner, heat resistance modification was evaluated. As a result, an increase in temperature at which the viscosity became $1.0\times10^5$ Pa·s was 15° C., and excellent heat resistance modification could be achieved.

The returning time was measured by setting the first set value to 160° C. and the second set value to 110° C. As a result, the returning time was 15 seconds.

Furthermore, printing using the toner described above was performed, and durability, low temperature offset resistance, and high temperature offset resistance were evaluated. Here, the first and second set values are as described above. As a result, the number of printed sheets until the outer peripheral surface of the heating roller was damaged was $500\times10^3$, and excellent durability could be achieved. The maximum temperature that caused the low temperature offset was 110° C., and excellent low temperature offset resistance could be achieved. The minimum temperature at which high temperature offset occurred was 190° C., and sufficient high temperature offset resistance could be achieved.

Example 3

Using the toner of Example 2, the returning time was measured and the durability was evaluated by setting the first and second set values to 160° C. and 150° C., respectively. As a result, the returning time was 6 seconds. The number of printed sheets until the outer peripheral surface of the heating roller was damaged was $400\times10^3$, and sufficient durability could be achieved.

Example 4

The following materials were sufficiently mixed with a Henschel mixer. A blending ratio of these materials was as follows:

| | |
|---|---|
| Crystalline polyester resin PEb | 10 parts by mass |
| Non-crystalline polyester resin PEC | 79 parts by mass |
| Ester wax | 6 parts by mass |
| Colorant | 5 parts by mass |

Here, the crystalline polyester resin PEb was obtained by polycondensation of an alcohol component and a carboxylic acid component as an esterification catalyst, and had a melting point of 95° C. and a gel content of 0%. The non-crystalline polyester resin PEC was obtained by polycondensation of an alcohol component and a carboxylic acid component using a titanium compound as an esterification catalyst, and had a softening point of 130° C. and a gel content of 13% by mass. As the ester wax and the colorant, the same ester wax and colorant as in Example 1 were used.

Next, this mixture was melt-kneaded with a twin-screw extruder. After cooling the melt-kneaded mixture, the melt-kneaded mixture was pulverized and classified. By doing as described above, toner particles having an average particle diameter of 8.5 μm were obtained.

Next, toner particles and external additives were mixed to obtain a toner. The external additive and the amount thereof were the same as in Example 1.

For this toner, the gel content was measured. As a result, the gel content of this toner was 11% by mass.

Next, for this toner, the storage stability were evaluated. As a result, the amount of toner remaining on the sieve was 0.7 g, and sufficient storage stability could be achieved.

For this toner, heat resistance modification was evaluated. As a result, an increase in temperature at which the viscosity became $1.0\times10^5$ Pa·s was 20° C., and excellent heat resistance modification could be achieved.

The returning time was measured by setting the first set value to 160° C. and the second set value to 110° C. As a result, the returning time was 15 seconds.

Furthermore, printing using the toner described above was performed, and durability, low temperature offset resistance, and high temperature offset resistance were evaluated. Here, the first and second set values are as described above. As a result, the number of printed sheets until the outer peripheral surface of the heating roller was damaged was $380\times10^3$, and sufficient durability could be achieved. The maximum temperature that caused the low temperature offset was 125° C., and sufficient low temperature offset resistance could be achieved. The minimum temperature at which high temperature offset occurred was 200° C., and sufficient high temperature offset resistance could be achieved.

Example 5

Using the toner of Example 4, the returning time was measured and the durability was evaluated by setting the first and second set values to 160° C. and 150° C., respectively. As a result, the returning time was 6 seconds. The number of printed sheets until the outer peripheral surface of the heating roller was damaged was $350\times10^3$, and sufficient durability could be achieved.

Example 6

The following materials were sufficiently mixed with a Henschel mixer. A blending ratio of these materials was as follows:

| | |
|---|---|
| Crystalline polyester resin PEc | 10 parts by mass |
| Non-crystalline polyester resin PEB | 79 parts by mass |
| Ester wax | 6 parts by mass |
| Colorant | 5 parts by mass |

Here, the crystalline polyester resin PEc was obtained by polycondensation of an alcohol component and a carboxylic acid component without using an esterification catalyst, and had a melting point of 110° C. and a gel content of 0%. As the ester wax and colorant, the same ester wax and colorant as in Example 1 were used.

Next, this mixture was melt-kneaded with a twin-screw extruder. After cooling the melt-kneaded mixture, the melt-kneaded mixture was pulverized and classified. By doing as described above, toner particles having an average particle diameter of 8.5 μm were obtained.

Next, toner particles and external additives were mixed to obtain a toner. The external additive and the amount thereof were the same as in Example 1.

For this toner, the gel content was measured. As a result, the gel content of this toner was 4% by mass.

Next, for this toner, the storage stability were evaluated. As a result, the amount of toner remaining on the sieve was 0.5 g, and excellent storage stability could be achieved.

For this toner, heat resistance modification was evaluated. As a result, an increase in temperature at which the viscosity became $1.0\times10^5$ Pa·s was 15° C., and excellent heat resistance modification could be achieved.

The returning time was measured by setting the first set value to 160° C. and the second set value to 110° C. As a result, the returning time was 15 seconds.

Furthermore, printing using the toner described above was performed, and durability, low temperature offset resistance, and high temperature offset resistance were evaluated. Here, the first and second set values are as described above. As a result, the number of printed sheets until the outer peripheral surface of the heating roller was damaged was $410\times10^3$, and sufficient durability could be achieved. The maximum temperature that caused the low temperature offset was 120° C., and sufficient low temperature offset resistance could be achieved. The minimum temperature at which high temperature offset occurred was 195° C., and sufficient high temperature offset resistance could be achieved.

Example 7

Using the toner of Example 6, the returning time was measured and the durability was evaluated by setting the first and second set values to 160° C. and 150° C., respectively. As a result, the returning time was 6 seconds. The number of printed sheets until the outer peripheral surface of the heating roller was damaged was $380\times10^3$, and sufficient durability could be achieved.

Example 8

The following materials were sufficiently mixed with a Henschel mixer. A blending ratio of these materials was as follows:

| | |
|---|---|
| Crystalline polyester resin PEc | 10 parts by mass |
| Non-crystalline polyester resin PEC | 79 parts by mass |
| Ester wax | 6 parts by mass |
| Colorant | 5 parts by mass |

Here, as the ester wax and colorant, the same ester wax and colorant as in Example 1 were used.

Next, this mixture was melt-kneaded with a twin-screw extruder. After cooling the melt-kneaded mixture, the melt-kneaded mixture was pulverized and classified. By doing as described above, toner particles having an average particle diameter of 8.5 μm were obtained.

Next, toner particles and external additives were mixed to obtain a toner. The external additive and the amount thereof were the same as in Example 1.

For this toner, the gel content was measured. As a result, the gel content of this toner was 11% by mass.

Next, for this toner, the storage stability were evaluated. As a result, the amount of toner remaining on the sieve was 0.3 g, and excellent storage stability could be achieved.

For this toner, heat resistance modification was evaluated. As a result, an increase in temperature at which the viscosity became $1.0\times10^5$ Pa·s was 25° C., and excellent heat resistance modification could be achieved.

The returning time was measured by setting the first set value to 160° C. and the second set value to 110° C. As a result, the returning time was 15 seconds.

Furthermore, printing using the toner described above was performed, and durability, low temperature offset resistance, and high temperature offset resistance were evaluated. Here, the first and second set values are as described above. As a result, the number of printed sheets until the outer peripheral surface of the heating roller was damaged was $360\times10^3$, and sufficient durability could be achieved. The maximum temperature that caused the low temperature offset was 130° C., and sufficient low temperature offset resistance could be achieved. The minimum temperature at which high temperature offset occurred was 210° C., and excellent high temperature offset resistance could be achieved.

Example 9

Using the toner of Example 8, the returning time was measured and the durability was evaluated by setting the first and second set values to 160° C. and 150° C., respectively. As a result, the returning time was 6 seconds. The number of printed sheets until the outer peripheral surface of the heating roller was damaged was $340\times10^3$, and sufficient durability could be achieved.

Comparative Example 1

The following materials were sufficiently mixed with a Henschel mixer. A blending ratio of these materials was as follows:

| | |
|---|---|
| Crystalline polyester resin PEd | 10 parts by mass |
| Non-crystalline polyester resin PEB | 79 parts by mass |
| Ester wax | 6 parts by mass |
| Colorant | 5 parts by mass |

Here, the crystalline polyester resin PEd was obtained by polycondensation of an alcohol component and a carboxylic acid component using a titanium compound as an esterification catalyst, and had a melting point of 95° C. and a gel content of 0%. As the ester wax and colorant, the same ester wax and colorant as in Example 1 were used.

Next, this mixture was melt-kneaded with a twin-screw extruder. After cooling the melt-kneaded mixture, the melt-kneaded mixture was pulverized and classified. By doing as described above, toner particles having an average particle diameter of 8.5 μm were obtained.

Next, toner particles and external additives were mixed to obtain a toner. The external additive and the amount thereof were the same as in Example 1.

For this toner, the gel content was measured. As a result, the gel content of this toner was 4% by mass.

Next, for this toner, the storage stability were evaluated. As a result, the amount of toner remaining on the sieve was 0.6 g, and sufficient storage stability could be achieved.

For this toner, heat resistance modification was evaluated. As a result, an increase in temperature at which the viscosity became $1.0\times10^5$ Pa·s was 45° C., and the heat resistance modification was insufficient.

The returning time was measured by setting the first set value, which is the temperature during printing, to 160° C. and the second set value, which is the temperature during standby, to 110° C. As a result, the returning time was 15 seconds.

Furthermore, printing using the toner described above was performed, and durability, low temperature offset resistance, and high temperature offset resistance were evaluated. Here, the first and second set values are as described above. As a result, the maximum temperature that caused the low temperature offset was 120° C., and sufficient low temperature offset resistance could be achieved. The minimum temperature that caused the high temperature offset was 190° C., and sufficient high temperature offset resistance could be achieved. However, the number of printed sheets until the outer peripheral surface of the heating roller was damaged was $170\times10^3$, and the durability was insufficient.

Comparative Example 2

The following materials were sufficiently mixed with a Henschel mixer. A blending ratio of these materials was as follows:

| | |
|---|---|
| Crystalline polyester resin PEd | 10 parts by mass |
| Non-crystalline polyester resin PEC | 79 parts by mass |
| Ester wax | 6 parts by mass |
| Colorant | 5 parts by mass |

Here, as the ester wax and colorant, the same ester wax and colorant as in Example 1 were used.

Next, this mixture was melt-kneaded with a twin-screw extruder. After cooling the melt-kneaded mixture, the melt-kneaded mixture was pulverized and classified. By doing as described above, toner particles having an average particle diameter of 8.5 μm were obtained.

Next, toner particles and external additives were mixed to obtain a toner. The external additive and the amount thereof were the same as in Example 1.

For this toner, the gel content was measured. As a result, the gel content of this toner was 11% by mass.

Next, for this toner, the storage stability were evaluated. As a result, the amount of toner remaining on the sieve was 0.6 g, and sufficient storage stability could be achieved.

For this toner, heat resistance modification was evaluated. As a result, an increase in temperature at which the viscosity became $1.0\times10^5$ Pa·s was 55° C., and the heat resistance modification was insufficient.

The returning time was measured by setting the first set value, which is the temperature during printing, to 160° C. and the second set value, which is the temperature during standby, to 110° C. As a result, the returning time was 15 seconds.

Furthermore, printing using the toner described above was performed, and durability, low temperature offset resistance, and high temperature offset resistance were evaluated. Here, the first and second set values are as described above. As a result, the maximum temperature that caused the low temperature offset was 125° C., and sufficient low temperature offset resistance could be achieved. The minimum temperature that caused the high temperature offset was 200° C., and sufficient high temperature offset resistance could be achieved. However, the number of printed sheets until the outer peripheral surface of the heating roller was damaged was $150\times10^3$, and the durability was insufficient.

Comparative Example 3

The following materials were sufficiently mixed with a Henschel mixer. A blending ratio of these materials was as follows:

| | |
|---|---|
| Crystalline polyester resin PEe | 10 parts by mass |
| Non-crystalline polyester resin PEC | 79 parts by mass |
| Ester wax | 6 parts by mass |
| Colorant | 5 parts by mass |

Here, the crystalline polyester resin PEe was obtained by polycondensation of an alcohol component and a carboxylic acid component without an esterification catalyst, and had a melting point of 60° C. and a gel content of 0%. As the ester wax and colorant, the same ester wax and colorant as in Example 1 were used.

Next, this mixture was melt-kneaded with a twin-screw extruder. After cooling the melt-kneaded mixture, the melt-kneaded mixture was pulverized and classified. By doing as described above, toner particles having an average particle diameter of 8.5 μm were obtained.

Next, toner particles and external additives were mixed to obtain a toner. The external additive and the amount thereof were the same as in Example 1.

For this toner, the gel content was measured. As a result, the gel content of this toner was 4% by mass.

Next, for this toner, the storage stability were evaluated. As a result, the amount of toner remaining on the sieve was 5.3 g, and the storage stability were insufficient.

For this toner, heat resistance modification was evaluated. As a result, an increase in temperature at which the viscosity became $1.0\times10^5$ Pa·s was 30° C., and sufficient heat resistance modification could be achieved.

The returning time was measured by setting the first set value to 160° C. and the second set value to 110° C. As a result, the returning time was 15 seconds.

Furthermore, printing using the toner described above was performed, and durability, low temperature offset resistance, and high temperature offset resistance were evaluated. Here, the first and second set values are as described above. As a result, the number of printed sheets until the outer peripheral surface of the heating roller was damaged was $390\times10^3$, and sufficient durability could be achieved. The maximum temperature that caused the low temperature offset was 105° C., and excellent low temperature offset resistance could be achieved. However, the minimum temperature that caused the high temperature offset was 165° C., and the high temperature offset resistance was insufficient.

Comparative Example 4

The following materials were sufficiently mixed with a Henschel mixer. A blending ratio of these materials was as follows:

| | |
|---|---|
| Crystalline polyester resin PEf | 10 parts by mass |
| Non-crystalline polyester resin PEC | 79 parts by mass |
| Ester wax | 6 parts by mass |
| Colorant | 5 parts by mass |

Here, the crystalline polyester resin PEf was obtained by polycondensation of an alcohol component and a carboxylic acid component without an esterification catalyst, and had a melting point of 75° C. and a gel content of 0% by mass. As the ester wax and colorant, the same ester wax and colorant as in Example 1 were used.

Next, this mixture was melt-kneaded with a twin-screw extruder. After cooling the melt-kneaded mixture, the melt-kneaded mixture was pulverized and classified. By doing as described above, toner particles having an average particle diameter of 8.5 μm were obtained.

Next, toner particles and external additives were mixed to obtain a toner. The external additive and the amount thereof were the same as in Example 1.

For this toner, the gel content was measured. As a result, the gel content of this toner was 4% by mass.

Next, for this toner, the storage stability were evaluated. As a result, the amount of toner remaining on the sieve was 2.2 g, and the storage stability were insufficient.

For this toner, heat resistance modification was evaluated. As a result, an increase in temperature at which the viscosity became $1.0\times10^5$ Pa·s was 35° C., and sufficient heat resistance modification could be achieved.

The returning time was measured by setting the first set value to 160° C. and the second set value to 130° C. As a result, the returning time was 12 seconds.

Furthermore, printing using the toner described above was performed, and durability, low temperature offset resistance, and high temperature offset resistance were evaluated. Here, the first and second set values are as described above. As a result, the number of printed sheets until the outer peripheral surface of the heating roller was damaged was $380\times10^3$, and sufficient durability could be achieved. The maximum temperature that caused the low temperature offset was 110° C., and excellent low temperature offset resistance could be achieved. However, the minimum temperature that caused the high temperature offset was 170° C., and the high temperature offset resistance was insufficient.

Comparative Example 5

The following materials were sufficiently mixed with a Henschel mixer. A blending ratio of these materials was as follows:

| | |
|---|---|
| Crystalline polyester resin PEg | 10 parts by mass |
| Non-crystalline polyester resin PEB | 79 parts by mass |
| Ester wax | 6 parts by mass |
| Colorant | 5 parts by mass |

Here, the crystalline polyester resin PEg was obtained by polycondensation of an alcohol component and a carboxylic acid component without an esterification catalyst, and had a melting point of 115° C. and a gel content of 0% by mass. As the ester wax and colorant, the same ester wax and colorant as in Example 1 were used.

Next, this mixture was melt-kneaded with a twin-screw extruder. After cooling the melt-kneaded mixture, the melt-kneaded mixture was pulverized and classified. By doing as described above, toner particles having an average particle diameter of 8.5 μm were obtained.

Next, toner particles and external additives were mixed to obtain a toner. The external additive and the amount thereof were the same as in Example 1.

For this toner, the gel content was measured. As a result, the gel content of this toner was 11% by mass.

Next, for this toner, the storage stability were evaluated. As a result, the amount of toner remaining on the sieve was 0.2 g, and excellent storage stability could be achieved.

For this toner, heat resistance modification was evaluated. As a result, an increase in temperature at which the viscosity became $1.0\times10^5$ Pa·s was 25° C., and sufficient heat resistance modification could be achieved.

The returning time was measured by setting the first set value to 160° C. and the second set value to 130° C. As a result, the returning time was 12 seconds.

Furthermore, printing using the toner described above was performed, and durability, low temperature offset resistance, and high temperature offset resistance were evaluated. Here, the first and second set values are as described above. As a result, the number of printed sheets until the outer peripheral surface of the heating roller was damaged was $360\times10^3$, and sufficient durability could be achieved. The minimum temperature that caused the high temperature offset was 210° C., and excellent high temperature offset resistance could be achieved. However, the maximum temperature that caused the low temperature offset was 155° C., and the low temperature offset resistance was insufficient.

Comparative Example 6

The following materials were sufficiently mixed with a Henschel mixer. A blending ratio of these materials was as follows:

| | |
|---|---|
| Crystalline polyester resin PEh | 10 parts by mass |
| Non-crystalline polyester resin PEB | 79 parts by mass |
| Ester wax | 6 parts by mass |
| Colorant | 5 parts by mass |

Here, the crystalline polyester resin PEh was obtained by polycondensation of an alcohol component and a carboxylic acid component without an esterification catalyst, and had a melting point of 130° C. and a gel content of 0% by mass. As the ester wax and colorant, the same ester wax and colorant as in Example 1 were used.

Next, this mixture was melt-kneaded with a twin-screw extruder. After cooling the melt-kneaded mixture, the melt-kneaded mixture was pulverized and classified. By doing as described above, toner particles having an average particle diameter of 8.5 μm were obtained.

Next, toner particles and external additives were mixed to obtain a toner. The external additive and the amount thereof were the same as in Example 1.

For this toner, the gel content was measured. As a result, the gel content of this toner was 11% by mass.

Next, for this toner, the storage stability were evaluated. As a result, the amount of toner remaining on the sieve was 0.3 g, and excellent storage stability could be achieved.

For this toner, heat resistance modification was evaluated. As a result, an increase in temperature at which the viscosity became $1.0\times10^5$ Pa·s was 20° C., and excellent heat resistance modification could be achieved.

The returning time was measured by setting the first set value to 160° C. and the second set value to 130° C. As a result, the returning time was 12 seconds.

Furthermore, printing using the toner described above was performed, and durability, low temperature offset resistance, and high temperature offset resistance were evaluated. Here, the first and second set values are as described above. As a result, the number of printed sheets until the outer peripheral surface of the heating roller was damaged was $365\times10^3$, and sufficient durability could be achieved. The minimum temperature that caused the high temperature offset was 210° C., and sufficient high temperature offset resistance could be achieved. However, the maximum temperature that caused the low temperature offset was 165° C., and the low temperature offset resistance was insufficient.

Comparative Example 7

The following materials were sufficiently mixed with a Henschel mixer. A blending ratio of these materials was as follows:

| | |
|---|---|
| Crystalline polyester resin PEc | 10 parts by mass |
| Non-crystalline polyester resin PED | 79 parts by mass |
| Ester wax | 6 parts by mass |
| Colorant | 5 parts by mass |

Here, the non-crystalline polyester resin PED was obtained by polycondensation of an alcohol component and a carboxylic acid component using a titanium compound as an esterification catalyst, and had a softening point of 95° C. and a gel content of 0% by mass. As the ester wax and colorant, the same ester wax and colorant as in Example 1 were used.

Next, this mixture was melt-kneaded with a twin-screw extruder. After cooling the melt-kneaded mixture, the melt-kneaded mixture was pulverized and classified. By doing as described above, toner particles having an average particle diameter of 8.5 μm were obtained.

Next, toner particles and external additives were mixed to obtain a toner. The external additive and the amount thereof were the same as in Example 1.

For this toner, the gel content was measured. As a result, the gel content of this toner was 0% by mass.

Next, for this toner, the storage stability were evaluated. As a result, the amount of toner remaining on the sieve was 1.6 g, and the storage stability were insufficient.

For this toner, heat resistance modification was evaluated. As a result, an increase in temperature at which the viscosity became $1.0\times10^5$ Pa·s was 5° C., and excellent heat resistance modification could be achieved.

The returning time was measured by setting the first set value to 160° C. and the second set value to 130° C. As a result, the returning time was 12 seconds.

Furthermore, printing using the toner described above was performed, and durability, low temperature offset resistance, and high temperature offset resistance were evaluated. Here, the first and second set values are as described above. As a result, the number of printed sheets until the outer peripheral surface of the heating roller was damaged was $510\times10^3$, and excellent durability could be achieved. The maximum temperature that caused the low temperature offset was 115° C., and excellent low temperature offset resistance could be achieved. However, the minimum temperature that caused the high temperature offset was 175° C., and the high temperature offset resistance was insufficient.

Comparative Example 8

The following materials were sufficiently mixed with a Henschel mixer. A blending ratio of these materials was as follows:

| | |
|---|---|
| Crystalline polyester resin PEc | 10 parts by mass |
| Non-crystalline polyester resin PEE | 79 parts by mass |
| Ester wax | 6 parts by mass |
| Colorant | 5 parts by mass |

Here, the non-crystalline polyester resin PEE was obtained by polycondensation of an alcohol component and a carboxylic acid component using a titanium compound as an esterification catalyst, and had a softening point of 110° C. and a gel content of 3% by mass. As the ester wax and colorant, the same ester wax and colorant as in Example 1 were used.

Next, this mixture was melt-kneaded with a twin-screw extruder. After cooling the melt-kneaded mixture, the melt-kneaded mixture was pulverized and classified. By doing as described above, toner particles having an average particle diameter of 8.5 μm were obtained.

Next, toner particles and external additives were mixed to obtain a toner. The external additive and the amount thereof were the same as in Example 1.

For this toner, the gel content was measured. As a result, the gel content of this toner was 2% by mass.

Next, for this toner, the storage stability were evaluated. As a result, the amount of toner remaining on the sieve was 1.2 g, and the storage stability were insufficient.

For this toner, heat resistance modification was evaluated. As a result, an increase in temperature at which the viscosity became $1.0\times10^5$ Pa·s was 5° C., and excellent heat resistance modification could be achieved.

The returning time was measured by setting the first set value to 160° C. and the second set value to 130° C. As a result, the returning time was 12 seconds.

Furthermore, printing using the toner described above was performed, and durability, low temperature offset resistance, and high temperature offset resistance were evaluated. Here, the first and second set values are as described above. As a result, the number of printed sheets until the outer peripheral surface of the heating roller was damaged was $490\times10^3$, and excellent durability could be achieved. The maximum temperature that caused the low temperature offset was 120° C., and sufficient low temperature offset resistance could be achieved. However, the minimum temperature that caused the high temperature offset was 180° C., and the high temperature offset resistance was insufficient.

Comparative Example 9

The following materials were sufficiently mixed with a Henschel mixer. A blending ratio of these materials was as follows:

| | |
|---|---|
| Crystalline polyester resin PEb | 10 parts by mass |
| Non-crystalline polyester resin PEF | 79 parts by mass |
| Ester wax | 6 parts by mass |
| Colorant | 5 parts by mass |

Here, the non-crystalline polyester resin PEF was obtained by polycondensation of an alcohol component and a carboxylic acid component using a titanium compound as an esterification catalyst, and had a softening point of 135° C. and a gel content of 16% by mass. As the ester wax and colorant, the same ester wax and colorant as in Example 1 were used.

Next, this mixture was melt-kneaded with a twin-screw extruder. After cooling the melt-kneaded mixture, the melt-kneaded mixture was pulverized and classified. By doing as described above, toner particles having an average particle diameter of 8.5 μm were obtained.

Next, toner particles and external additives were mixed to obtain a toner. The external additive and the amount thereof were the same as in Example 1.

For this toner, the gel content was measured. As a result, the gel content of this toner was 12% by mass.

Next, for this toner, the storage stability were evaluated. As a result, the amount of toner remaining on the sieve was 0.7 g, and sufficient storage stability could be achieved.

For this toner, heat resistance modification was evaluated. As a result, an increase in temperature at which the viscosity became $1.0\times10^5$ Pa·s was 55° C., and heat resistance modification was insufficient.

The returning time was measured by setting the first set value to 160° C. and the second set value to 130° C. As a result, the returning time was 12 seconds.

Furthermore, printing using the toner described above was performed, and durability, low temperature offset resistance, and high temperature offset resistance were evaluated. Here, the first and second set values are as described above. As a result, the minimum temperature that caused the high temperature offset was 205° C., and excellent high temperature offset resistance could be achieved. However, the number of printed sheets until the outer peripheral surface of the heating roller was damaged was $200\times10^3$, and the durability was insufficient. The maximum temperature that caused the low temperature offset was 155° C., and low temperature offset resistance was insufficient.

Comparative Example 10

The following materials were sufficiently mixed with a Henschel mixer. A blending ratio of these materials was as follows:

| | |
|---|---|
| Crystalline polyester resin PEb | 10 parts by mass |
| Non-crystalline polyester resin PEG | 79 parts by mass |

-continued

| | |
|---|---|
| Ester wax | 6 parts by mass |
| Colorant | 5 parts by mass |

Here, the non-crystalline polyester resin PEG was obtained by polycondensation of an alcohol component and a carboxylic acid component using a titanium compound as an esterification catalyst and had a softening point of 140° C. and a gel content of 20% by mass. As the ester wax and the colorant, the same ester wax and colorant as in Example 1 were used.

Next, this mixture was melt-kneaded with a twin-screw extruder. After cooling the melt-kneaded mixture, the melt-kneaded mixture was pulverized and classified. By doing as described above, toner particles having an average particle diameter of 8.5 μm were obtained.

Next, toner particles and external additives were mixed to obtain a toner. The external additive and the amount thereof were the same as in Example 1.

For this toner, the gel content was measured. As a result, the gel content of this toner was 16% by mass.

Next, for this toner, the storage stability were evaluated. As a result, the amount of toner remaining on the sieve was 0.6 g, and sufficient storage stability could be achieved.

For this toner, heat resistance modification was evaluated. As a result, an increase in temperature at which the viscosity became $1.0\times10^5$ Pa·s was 65° C., and heat resistance modification was insufficient.

The returning time was measured by setting the first set value to 160° C. and the second set value to 130° C. As a result, the returning time was 12 seconds.

Furthermore, printing using the toner described above was performed, and durability, low temperature offset resistance, and high temperature offset resistance were evaluated. Here, the first and second set values are as described above. As a result, the minimum temperature that caused the high temperature offset was 225° C., and excellent high temperature offset resistance could be achieved. However, the number of printed sheets until the outer peripheral surface of the heating roller was damaged was $180\times10^3$, and the durability was insufficient. The maximum temperature that caused the low temperature offset was 150° C., and low temperature offset resistance was insufficient.

The above results are summarized in Tables 1 and 2.

TABLE 1

| | heating roller temperature (° C.) | | crystalline polyester resin PE | | toner | | increase | offset resistance | | | | |
|---|---|---|---|---|---|---|---|---|---|---|---|---|
| | during printing | during standby | catalyst | melting point (° C.) | gel content (% by mass) | storage characteristics | in temperature (° C.) | low temperature | high temperature | Returning time | Durability | Comprehensive evaluation |
| Example 1 | 160 | 130 | absence | 95 | 8 | A | 25 | A | A | A | A | A |
| Example 2 | 160 | 110 | absence | 80 | 4 | A | 15 | AA | A | A | AA | A |
| Example 3 | 160 | 150 | absence | 80 | 4 | A | 15 | AA | A | AA | A | A |
| Example 4 | 160 | 110 | absence | 80 | 11 | A | 20 | A | A | A | A | A |
| Example 5 | 160 | 150 | absence | 80 | 11 | A | 20 | A | A | AA | A | A |
| Example 6 | 160 | 110 | absence | 110 | 4 | AA | 15 | A | A | A | A | A |
| Example 7 | 160 | 150 | absence | 110 | 4 | AA | 15 | A | A | AA | A | A |
| Example 8 | 160 | 110 | absence | 110 | 11 | AA | 25 | A | AA | A | A | A |
| Example 9 | 160 | 150 | absence | 110 | 11 | AA | 25 | A | AA | AA | A | A |

TABLE 2

| | heating roller temperature(° C.) | | crystalline polyester resin PE | | toner gel | storage | increase in temperature | offset resistance | | Re- | | Compre- |
|---|---|---|---|---|---|---|---|---|---|---|---|---|
| | during printing | during standby | catalyst | melting point | content (% by mass) | characteristics | (° C.) | low temperature | high temperature | turning time | Durability | hensive evaluation |
| Comparative example 1 | 160 | 110 | presence | 95 | 4 | A | 45 | A | A | A | B | B |
| Comparative example 2 | 160 | 110 | presence | 95 | 11 | A | 55 | A | A | A | B | B |
| Comparative example 3 | 160 | 130 | absence | 60 | 4 | B | 30 | AA | B | A | A | B |
| Comparative example 4 | 160 | 130 | absence | 75 | 4 | B | 35 | AA | B | A | A | B |
| Comparative example 5 | 160 | 130 | absence | 115 | 11 | AA | 25 | B | AA | A | A | B |
| Comparative example 6 | 160 | 130 | absence | 130 | 11 | AA | 20 | B | AA | A | A | B |
| Comparative example 7 | 160 | 130 | absence | 95 | 0 | B | 5 | AA | B | A | AA | B |
| Comparative example 8 | 160 | 130 | absence | 95 | 2 | B | 5 | A | B | A | AA | B |
| Comparative example 9 | 160 | 130 | absence | 95 | 12 | A | 55 | B | AA | A | B | B |
| Comparative example 10 | 160 | 130 | absence | 95 | 16 | A | 65 | B | AA | A | B | B |

As illustrated in Table 1, in Examples 1 to 9, all evaluations of the storage stability, durability, low temperature offset resistance, and high temperature offset resistance were AA or A, and the comprehensive evaluation thereof was A. In contrast, in Comparative Examples 1 to 10, as illustrated in Table 2, one or more evaluations of storage stability, durability, low temperature offset resistance, and high temperature offset resistance were B, and the comprehensive evaluation thereof was B.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. A toner, comprising:

toner particles comprising a colorant, non-crystalline polyester, and crystalline polyester, wherein the crystalline polyester does not contain an esterification catalyst and has a melting point in a range of 80 to 110° C., a gel content of the toner particles is in a range of 4 to 11% by mass, and the non-crystalline polyester has a softening point in a range of 100 to 140° C.

2. The toner according to claim 1, wherein the melting point of the crystalline polyester is in a range of 90 to 100° C.

3. The toner according to claim 1, wherein the non-crystalline polyester has a softening point in a range of 110 to 130° C.

4. The toner according to claim 1, wherein an amount of the crystalline polyester is in a range of 5 to 20 parts by mass with respect to 100 parts by mass of the non-crystalline polyester.

5. The toner according to claim 1, wherein an amount of the crystalline polyester is in a range of 10 to 15 parts by mass with respect to 100 parts by mass of the non-crystalline polyester.

6. The toner according to claim 1, wherein a ratio of a total amount of the crystalline polyester and the non-crystalline polyester to the amount of the toner particles is in a range of 70 to 95% by mass.

7. The toner according to claim 1, wherein a ratio of a total amount of the crystalline polyester and the non-crystalline polyester to the amount of the toner particles is in a range of 80 to 90% by mass.

8. The toner according to claim 1, wherein the crystalline polyester is a polycondensation product of one or more alcohol components selected from aliphatic diols having 2 to 16 carbon atoms and one or more carboxylic acid components selected from aliphatic dicarboxylic acid-based compounds having 4 to 14 carbon atoms.

9. The toner according to claim 1, wherein the non-crystalline polyester is a polycondensation product of one or more alcohol components selected from aliphatic diols having 2 to 4 carbon atoms having a hydroxyl group bonded to a secondary carbon atom and one or more carboxylic acid components selected from a group consisting of aromatic dicarboxylic acid-based compounds, aliphatic dicarboxylic acid-based compounds, and trivalent or higher carboxylic acid-based compounds.

10. A toner cartridge, comprising:

a container; and a developer in the container, the developer comprising toner particles including:

a colorant;

non-crystalline polyester; and crystalline polyester, wherein the crystalline polyester does not contain an esterification catalyst and has a melting point in a range of 80 to 110° C., a gel content of the toner particles is in a range of 4 to 11% by mass, and the non-crystalline polyester has a softening point in a range of 100 to 140° C.

11. The toner cartridge according to claim 10, wherein the melting point of the crystalline polyester is in a range of 90 to 100° C.

12. The toner cartridge according to claim 10, wherein the non-crystalline polyester has a softening point in a range of 100 to 140° C. 110 to 130° C.

13. The toner cartridge according to claim 10, wherein an amount of the crystalline polyester is in a range of 5 to 20 parts by mass with respect to 100 parts by mass of the non-crystalline polyester.

14. The toner cartridge according to claim 10, wherein a ratio of a total amount of the crystalline polyester and the non-crystalline polyester to the amount of the toner particles is in a range of 70 to 95% by mass.

15. The toner cartridge according to claim 10, wherein the non-crystalline polyester is a polycondensation product of one or more alcohol components selected from aliphatic diols having 2 to 4 carbon atoms having a hydroxyl group bonded to a secondary carbon atom and one or more carboxylic acid components selected from a group consisting of aromatic dicarboxylic acid-based compounds, aliphatic dicarboxylic acid-based compounds, and trivalent or higher carboxylic acid-based compounds.

16. An image forming apparatus comprising:

a photoreceptor on which an electrostatic latent image can be formed; and a developing device configured to supply a developer to the photoreceptor to form a toner image corresponding the electrostatic latent image, the developer including toner particles, the toner particles comprising:

a colorant, non-crystalline polyester, and crystalline polyester, wherein the crystalline polyester does not contain an esterification catalyst and has a melting point in the range of 80 to 110° C., the toner particles having a gel content which is in a range of 4 to 11% by mass, and the non-crystalline polyester has a softening point in a range of 100 to 140° C.

17. The image forming apparatus according to claim 16, further comprising:

a transfer device configured to transfer the toner image from the photoreceptor to a recording medium; and a fixing device configured to fix the toner image to the recording medium.

18. The image forming apparatus according to claim 17, wherein the fixing unit includes a heating roller, and the image forming apparatus further comprises a controller configured to control a temperature of the heating roller during standby to a temperature that is 10 to 50° C. lower than a temperature of the heating roller during printing.

19. The image forming apparatus according to claim 18, wherein the fixing device further includes a thermistor contacting the heating roller and configured to detect the temperature of the heating roller.

20. The image forming apparatus according to claim 18, wherein the controller is configured to control the temperature of the heating roller during printing to be within a range of 140 to 180° C.

* * * * *